US006279772B1

(12) United States Patent
Bowman

(10) Patent No.: US 6,279,772 B1
(45) Date of Patent: Aug. 28, 2001

(54) MANUALLY ACTUABLE FLUID DISPENSING UNIT AND PROCESS

(76) Inventor: Ronald Lee Bowman, 11957 Brook Rd., Golden, CO (US) 80403

( * ) Notice: Subject to any disclaimer, the term of this patent is extended or adjusted under 35 U.S.C. 154(b) by 0 days.

(21) Appl. No.: 09/372,186

(22) Filed: Aug. 11, 1999

(51) Int. Cl.[7] ..... B67D 3/00

(52) U.S. Cl. ..... 220/703; 222/175; 222/490; 251/342

(58) Field of Search ..... 220/703, 714; 251/342; 222/490, 175

(56) References Cited

U.S. PATENT DOCUMENTS 5,601,207 * 2/1997 Paczonay ..... 220/703
5,806,726 * 9/1998 Ho ..... 222/175 X
6,032,831 * 3/2000 Gardner et al. ..... 220/703 X
6,062,435 * 5/2000 Hess, III ..... 222/175
6,070,767 * 9/1998 Gardner et al. ..... 220/703 X

* cited by examiner

*Primary Examiner*—Joseph A. Kaufman
*Assistant Examiner*—Eric Keasel

(57) ABSTRACT

A flexible member is fabricated with four side walls forming a chamber which is coupled to a fluid source or reservoir on one side and has a slit through the end wall on the other side. The end wall is generally flat on its interior surface. Deformation of the side walls of the flexible member as by biting causes the end wall with the slit to deform and open the slit which otherwise is retained closed by the walls of the flexible member. This action establishes fluid dispensing from the source through the slit. The thickness of at least two of the side walls with respect to the slit containing end wall is greater than the end wall so that the pivoting hinge lines are established. Alternatively or in addition to the foregoing, a cut or groove into the interior of the end wall establishes a hinge line with cuts on either side of the slit thus establishing dual hinge lines.

10 Claims, 4 Drawing Sheets

MANUALLY ACTUABLE FLUID DISPENSING UNIT AND PROCESS

CROSS-REFERENCE TO RELATED APPLICATION

Co-pending U.S. Pat. application Ser. No. 09/179,337 filed Oct. 27, 1998 for Human Hydration System describes an environment suitable for use of the present invention.

BACKGROUND OF THE INVENTION

1. Field of Invention

The present invention relates to the field of human hydration systems. In particular the present invention relates to a liquid dispensing valve for a human hydration system that improves performance in sustaining a column of liquid and enhanced performance. The present invention is particularly useful as a bite actuated liquid dispensing valve that is particularly advantageous for use in sub-freezing conditions.

2. Description of Related Art

Human hydration systems are used to hydrate or re-hydrate a person that is losing body fluids typically as a result of physical exertion, heat or a combination of the two. Prior hydration systems are generally constructed of a pliable soft liquid reservoir, a length of flexible tubing with the proximal end connected to the reservoir and a liquid dispensing unit connected to the tubing at the distal end. The liquid dispensing unit is generally constructed of a pliable material and is tube-like in design. The tube design has an open end that connects to the flexible tube and a closed end that contains through slits. The through slits are closed and must be opened by a biting action on the outer surface of the liquid dispensing unit which deforms the pliable material opening the slits. Once the slits open, liquid is drawn into the user's mouth by a sucking action.

Many hydration systems are designed to be transported on the back of the user. This places the liquid reservoir at an elevated distance above the liquid dispensing unit when the user is riding a bicycle or climbing at steep angles. This elevated position of the reservoir creates positive pressure in the liquid dispensing unit. If the liquid dispensing unit is incapable of containing the positive pressure, the liquid dispensing unit will leak often vacating the reservoir. Several liquid dispensing units in the prior art are designed to maintain static positive pressure under normal conditions.

For instance, U.S. Pat. No. 5,085,349 states that a positive static head of eight feet can be maintained with an initial wall thickness of 0.350 inch where the through slit is located. This is accomplished by using internal walls sloping at angles to the direction of fluid flow. U.S. Pat. No. 5,730,336 states that resistance to liquid flow is accomplished by a convex shaped inner wall in the liquid dispensing unit. In turn, a concave outer wall is used to allow pressure from outside the liquid dispensing unit to easily overcome the construction of the convex wall causing the through slit to open. In U.S. Pat. No. 5,791,510, FIG. 1 shows a partial diagram of a cyclist with a liquid supply at or below the level of the liquid dispensing unit. This patent describes a liquid dispensing unit that has an improved flow over previous dispensing units but is not capable of containing positive or negative pressure exerted on the dispensing unit.

Some liquid reservoirs, such as bottles and canteens, are located at an elevation lower than the liquid dispensing unit. The location of this type of reservoir creates several situations, as the liquid dispensing unit must hold a negative static column of liquid in the tubing that connects the liquid reservoir to the liquid dispensing unit. If this static column of liquid is not maintained the liquid will equalize returning to the liquid reservoir. For the user to obtain liquid from the reservoir, a sustained negative pressure, along with a biting action, must be applied to the liquid dispensing unit. This action creates a delay of liquid delivery and often frustration to the user. When the liquid dispensing unit is positioned lower than the fluid reservoir a positive static column of fluid is created. This can occur when the user is engaged in activities such as mountain climbing or camping.

Also, positive pressure is created in the fluid dispensing unit under such circumstances as when the fluid reservoir is compressed securing it into position, or when it is placed under sudden pressure as when a fall may occur trapping the fluid reservoir between the carrier and another surface. A liquid dispensing unit is preferred which is capable of maintaining a positive static pressure as well as negative static pressure of a liquid column without leaking fluid.

In addition to these concerns, another concern is low temperature freeze up of current liquid dispensing units. If a hydration system is used in a temperature range whereas water remains a liquid, generally no problems with the average liquid dispensing valve are encountered. In conditions where the temperature will fall below the freezing point of the liquid contained in the hydration system, the liquid dispensing valve will become inoperable due to the liquid contained in the liquid dispensing valve freezing and not allowing liquid to pass through the valve to the user.

Many hydration systems such as one known by the name PLATYPUS, utilize a means of attaching the fluid dispensing valve to the fluid tube by an annular internal friction connection. This type of connection creates a reduction in annular area of liquid to move through the connection. At this area of restricted liquid movement, liquid has a propensity to freeze faster than the remainder of the system since a smaller volume of liquid will loose heat faster to the freezing temperature. This is a ratio factor of a higher surface area to volume of liquid.

The so-called CAMELBACK hydration system uses a neoprene cover over the liquid delivery tube that extends from a liquid storage source to the liquid dispensing valve. The liquid dispensing valve, in turn, is covered by a temporarily removable foam insulating sheath that must be removed prior to withdrawing liquid from the dispensing valve. This system is cumbersome and does not permit hands free hydration since the foam insulating sheath that covers the liquid dispensing valve must be removed by the user with his hands prior to use.

When ice begins to form on the interior walls of all current liquid dispensing units, it may be dislodged from the interior walls by a biting action to the exterior walls of the liquid dispensing valve. An attempt of clearing or eliminating ice buildup from a current liquid dispensing valve often creates an ice damming effect, by creating ice shards too large to pass through the opening of the liquid dispensing valve. This damming effect of the ice hinders liquid flowing through the dispensing valve, eventually creating a complete freeze up condition of the liquid dispensing unit.

Water will freeze in a hydration system particularly in a liquid dispensing unit when subjected to temperatures below that which water remains a liquid in a static state. Since liquid contained in a hydration system, including the liquid dispensing unit, is generally in a static state, with the exception of liquid flowing through the system to the user for ingestion, the hydration system freezes becoming inoperable.

Based on the above and other problems with the relevant art, it is an object of the present invention to create a liquid dispensing unit that will maintain a fluid column in a delivery tube from a fluid reservoir to the fluid dispensing unit under a negative and positive static state of pressure on the liquid dispensing unit. Another object of the present invention is to create a liquid dispensing unit that will properly form and divide ice, forming within the liquid dispensing unit, into shards that creates a high ratio of surface area to volume. This will cause the ice shards to melt as liquid flows around them passing through the liquid dispensing unit.

SUMMARY OF THE INVENTION

The above discussed and other problems with the prior art are overcome by the liquid dispensing unit of the present invention. The present invention comprises a two piece liquid dispensing unit. One piece is constructed of a resilient plastic or polymer that remains flexible at temperatures below the freezing point of water or a water based constituent liquid. This part acts as a seal or capping member to a tube extending from a reservoir which contains a liquid to be ingested by the user.

The flexible member contains a through slit which is selectably openable for joining an inner void or chamber with the outside area. The slit is forced into a normally closed position by the action and memory of the resilient material and predetermined wall thickness and proper relationships to wall thickness. The slit can be opened by distorting the flexible member, generally by a biting action to outside opposing walls. When the slit is forced open, access to the contents of the liquid reservoir can be obtained by a sucking action on the flexible member. This creates negative pressure forcing liquid from the reservoir into the connecting tube and ultimately through the flexible member to the user.

When liquid to the user is no longer required, the slit closes by releasing the distorting pressure to the outer surface of the flexible member thus stopping liquid movement through the system. If the slit does not close or seal, the liquid will equalize in the system with relationship to the height of the reservoir and flexible member. This could cause the liquid to return to the reservoir if the reservoir was positioned lower than the flexible member. It could also cause liquid to exit the flexible member if the reservoir is positioned higher than the flexible member thus draining the reservoir.

It is preferred that liquid remain in the connecting tube to avoid delay to the user each time liquid is desired. It is also preferred that the through slit seal upon closure to prevent unwanted transfer of liquid through the flexible member. The present invention maintains a static negative column of liquid and a static positive column of liquid at a desired level. In other words, the present invention will prevent a liquid contained in a connecting tube from equalizing and dropping toward a liquid source positioned lower than the liquid dispensing unit and will prevent leakage from the liquid dispensing unit when a positive static head is applied from a liquid reservoir being placed at a greater elevation or when pressure is applied to the liquid reservoir. The flexible member, under actual testing, maintained a negative static column of 15 feet of liquid for over 36 hours. At that time testing was discontinued. Under positive static pressure the flexible member maintained an 8 feet column of liquid for over 36 hours with a wall thickness of only 0.080-inch and a positive static head of 12 feet for over 36 hours with a wall thickness of only 0.110 inch, before testing was discontinued.

This can be accomplished with a wall thickness much less than required in the prior art such as in U.S. Pat. No. 5,085,349, which employs a wall thickness of 0.350 inch, for maintaining an 8 feet positive static column of liquid. Other prior art such as U.S. Pat. Nos. 5,791,510 and 5,730,336 suggest that improved liquid flows occur with a more uniform wall thickness and a wall thickness less than 0.350 inch. The current invention can accomplish the above and more with a wall thickness of approximately 0.125 inch thick.

The flexible member will also allow the liquid dispensing unit to vacate available liquid from the liquid dispensing valve by releasing the seal of negative pressure that holds the liquid column. This will allow the static water column to return to the liquid source. This will minimize freeze-up of the system by accumulating the total volume of liquid into a mass of lowest surface area to volume.

Yet another advantage of the flexible member is to manage and eliminate ice that is created by any remaining liquid, turned to ice, in the liquid dispensing unit after it has been vacated of liquid in sub-freezing conditions. This is accomplished with the use of internal projections in the flexible member which creates an ice tray effect, dividing frozen fluid into pre-designed shapes that have a high surface area to volume ratio. This controlled division of the remaining ice in the flexible member causes the ice to be eliminated from the liquid dispensing unit by passing water over the shards, in effect melting them into a liquid state.

The second hard piece or coupling member is used to connect the flexible member to the connecting tube from the liquid reservoir. This member is attached to the connecting tube either through an internal annular friction fit of the tube or an external glue fit to the tube. The external glue fit provides less restrictive flow through the tube and hard member connection and is therefore preferred. This unrestricted flow of liquid is critical is in minimizing freeze up of the liquid dispensing unit. The hard member contains annular external and internal rings of various sizes at the end opposite of the connecting tube. These rings mate with corresponding annular rings in the flexible member which, when fitted together, creates a seal between the two pieces. Since this seal is a friction seal, the flexible member is easily removed for cleaning or replacement.

This liquid dispensing unit can increase the lower temperature range in which a hydration system can normally be used. Ice build up in any liquid dispensing unit of a portable hydration system in continual sub-freezing temperatures can be anticipated but the present invention will improve performance of a liquid dispensing unit in such conditions.

The present invention is a bite valve for attachment to a fluid supply tube. It includes a flexible housing having an internal cavity or chamber formed by four side wall members. A top wall member encloses these four side wall members on one end of the cavity. A fluid supply tube is attached in proximity to the other end of the internal cavity for establishing fluidic communication therewith.

Two of these side wall members are located as diametrically opposed wall members, and the other pair of side wall members are located as diametrically opposed side wall members that extend generally normal to the first pair of side wall members. A normally closed slit extends through the top wall member with this slit opening upon mouth pressure being applied to an opposing pair of side wall members thereby establishing a fluid flow line through cavity or chamber. The interior surface facing the internal chamber from the top wall is configured substantially flat and perpendicular to the fluid flow line through the interior chamber or cavity.

Thus, the bite valve cavity or chamber can be formed with a rectangular cross-section with the slit extending through the top wall extends in a direction transverse to the longer dimension of the rectangular cross-section formed by the side walls.

The bite valve exterior surface of the top wall member can be formed with a flat central surface containing the slit and at least two sloping side surfaces extending from the aforementioned central surface so as to form a truss-like profile.

A pair of grooves or cuts extending into the top wall member from its interior surface. These grooves or cuts are generally arranged parallel to the slit and located on respective sides thereof whereby hinge locations for flexing of the top wall member are established at each of these grooves. An externally extending mouth engaging stop member located remote from the front wall member functions as a tactile mouth insertion indicator. This bite valve mouth engaging stop member can be fabricated as an annular ridge extending outward from the flexible housing for physical engagement with the lips of a user.

The longer pair of the side walls can each include a channel extending parallel to the length of the cavity for entrapping ice when the bite valve is in a freezing environment. These channels each have ribs extending from the sides thereof into the interior of the cavity for facilitating release of ice formed within the chamber cavity.

The present invention includes the method of selectively extracting fluid from a fluid supply. This includes the steps of forming a flexible housing of side walls and an end wall defining an internal chamber with the end wall having a flat interior surface facing the chamber, establishing a slit through the end wall so that pressure differentials between the exterior and interior of the housing will cause the slit to increase closing pressure along an internal margin thereof, coupling the internal chamber to the fluid supply, and fabricating the side walls of the housing for accommodating manual collapse of the housing and opening of the slit for permitting transmission of fluid from the supply through the slit.

The method in accordance with this invention further contemplates the step of incorporating grooves on either side of the housing slit for establishing hinge lines. Additional method steps includes the step of forming channels within the chamber for facilitating removal of ice from within the chamber when the housing is subjected to a freezing environment. Forming the exterior surface of the end wall with a flat central portion and two sloping side portions on either side of the central portion can create a strong, truss-like contour for the end wall.

DETAILED DESCRIPTION OF THE PREFERRED EMBODIMENTS

Figure 1:
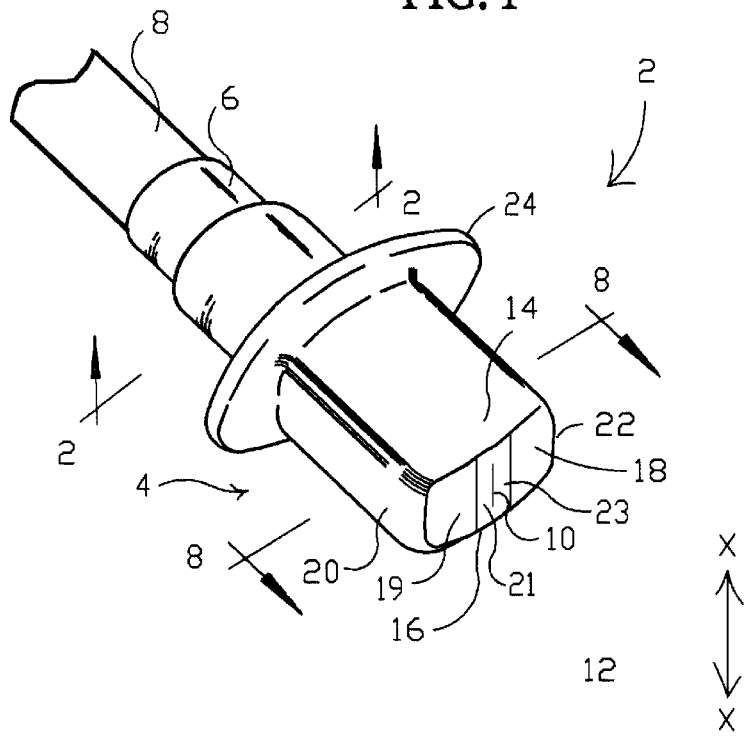
FIG. 1 is an isometric view of the liquid dispensing unit with a partial connecting tube that is normally attached to a liquid reservoir.

In FIG. 1 of the drawings, numeral 2 broadly indicates one exemplary embodiment of a fluid dispenser unit in accordance with the present invention. A flexible member 4 is joined to a coupler or hard member 6. Hard member 6 provides an interface between flexible member 4 and connecting tube 8 which functions as a fluid source. That is, member 6 is coupled to a connecting tube 8 at a proximal end of the connecting tube 8 to establish fluidic communication between member 4 and tube 8. A liquid reservoir (not shown) is connected at the remote distal end of the connecting tube 8. Through slit 10 joins the internal chamber formed by the walls of the flexible member 4 to the outside area 12 when applying opposing pressure to surfaces 14 and 16 forcefully opens the slit 10.

By way of example, flexible member 4 could be made of a urethane rubber compound such as DYNAFLEX G2711, and the adaptive coupler 6 could be constructed of FDA approved ABS plastic. While the preferred embodiments here described illustrate generally in-line fluid communication established between the interior chamber of member 4 and tube 8, those having normal skill in the art will recognize that other fluid coupling schemes are possible. Member 4 could be connected via an L-shaped coupler by way of example. Further, hard coupler member 6 can be omitted entirely under some circumstances.

Through slit 10 is normally forced into a closed position by tension exerted on the face surface 18, 19, 21 and 23 by opposing surfaces 20 and 22 and memory inherent to the material in which the flexible member 4 is constructed. Surfaces 20 and 22 exert a column tension on surface 18, 19, 21 and 23 as shown by arrows X—X. An elliptical projection 24 extends from the surface of flexible member 4 and creates a stop to prevent over insertion of the flexible member in the user's mouth. The elliptical projection assures repeatability of mouth placement and proper positioning of the biting action required for operating the liquid dispensing unit properly.

Figure 2:
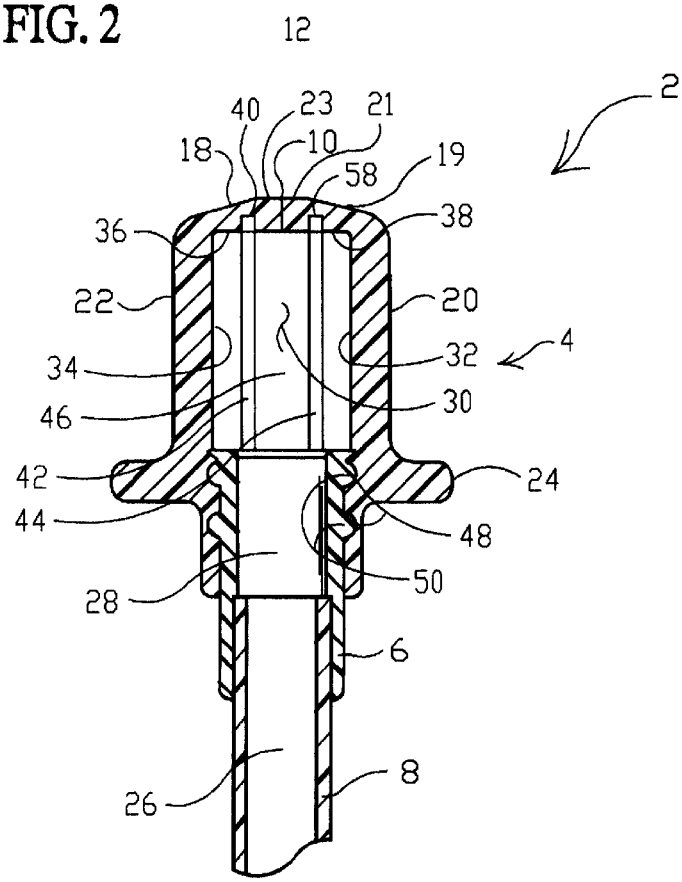
FIG. 2 is a cross-sectional view of FIG. 1 looking in the direction of the arrows indicated by 2—2.

FIG. 2 is a detailed cross-section of the present invention 2 as seen from arrows 2—2. Flexible member 4 contains an interior chamber or cavity 30 which is primarily defined, in part, by internal side walls 32, 34 and front internal side walls 36, 38. Side wall 34 joins front wall 36 at a right angle and side wall 32 joins front wall 38 at a right angle with both angles at least at 90 degrees or greater. Front internal walls 36 and 38 are bisected by through slit 10 and wall 36 contains a forward projecting groove or slit 40 and wall 38 contains a forward projecting cavity or slit 58. Chamber or cavity 30 and outside area 12 are connected when flexible member 4 is sufficiently deformed forcing slit 10 to open. This passage allows liquid from a liquid reservoir to reach the user.

Paired longitudinal ribs 42 and 44 project inwardly from internal surface 46. Projections 42 and 44 are raised from surface 46 approximately 0.050 inch and functionally become ice trays to any remaining water in the flexible member during sub-freezing conditions to the liquid dispensing unit. Liquid freezing into ice forms in and around projections 42 and 44 and creates an ice formation that has a high surface area to volume ratio.

Grooves or annular internal rings 48 of the flexible member 4 creates a water-tight seal by mating with external annular rings 50 of the hard member 6 of the fluid dispensing unit.

Coupler member 6 contains a through passageway 28 joining the connecting tube 8 passageway 26 to the cavity 30 of flexible member 4 of the liquid dispensing unit. Liquid is then available from a fluid reservoir, not shown, into passageway 26 of connecting tube 8 into opening 28 of member 6 into cavity 30 of flexible member 4 and through slit 10 to the user.

Figure 3:
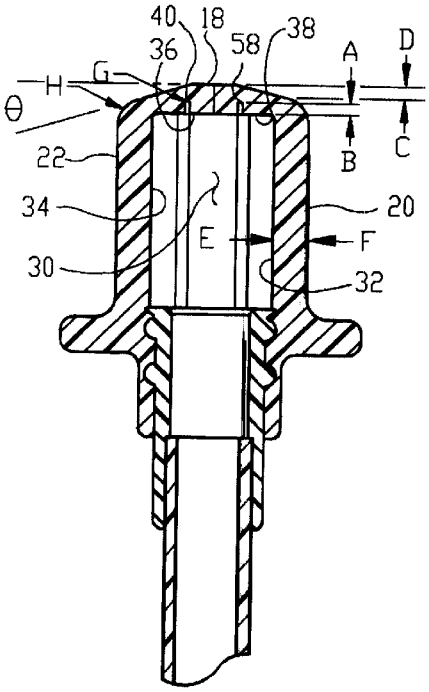
FIG. 3 is a cross-sectional view, as seen in FIG. 2, of an alternate embodiment of the present invention along with referenced dimensions for further discussion.
Figure 4:
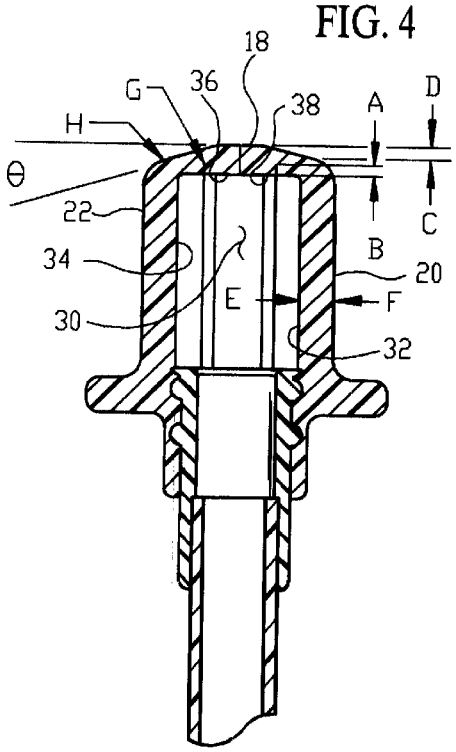
FIG. 4 is a cross-sectional view, as seen in FIG. 2, of an alternate embodiment of the present invention along with referenced dimensions for further discussion.

FIGS. 3 and 4 show alternate embodiments of the current invention of FIG. 2. FIG. 3 shows a narrower profile for inward projection cavity 40 and 58. FIG. 4. shows that only a forward slit of limited depth is used to form 40 and 58.

FIGS. 3 and 4 illustrate an angle θ created by surface 18 and 19. Surface 18 and 19 are flat or straight by construction and angled away from the body of member 4 starting at point "H". Surface 21 and 23 form an area that is bisected by through slit 10. Surface 21 and 23 may be on the same plane as surface 18 and 19 or may have a positive or negative angle away from surface 18 and 19. Generally, surface 21 and 23 provide an area for through slit 10 to be positioned. Surfaces 18 and 19 form a truss-like structure when viewed in cross-section. This angle truss design provides maximum resistance to inward collapse with a minimum of surface projection from points "H".

It should be noted that a straight surface or wall undergoes less internal stress from torque when flexing, inward than a curved or faceted structure performing the same function. Surfaces 18 and 19, being linear, transfers a majority of any stress into side walls denoted by surfaces 22, 34 and surfaces 20, 32. Through slit 10 is generally perpendicular to surface 18 and 19 and since surface 18 and 19 are flat or straight the seal created by through slit 10 is generally improved over other surface configurations.

Under the knowledge that a thicker wall of material will flex less readily than a thinner wall of the same material, a relationship of wall thickness becomes apparent. Material thickness between points E and F or from inner wall 32 to outer wall 20 is greater than material thickness between B and D. Under equal internal pressure of area 30, surface 36 and 38 will flex towards outside area 12 before surface 32 and 34 experience any flexing. Since a natural flexing area o f less material thickness is created by areas 40 and 58 in walls 16 and 38 the innermost walls of 36 and 38 will flex before the outer walls of 36 and 38.

The point of which surface 36 and 38 flexes or rotates about can be termed hinge point G and the point of which surface 18 and 19 flexes or rotates about can be termed hinge point H. The relationship between the hinge point and furthest most surfaces that rotates about the hinge point is critical. For hinge point G the distance denoted as A–B is critical as is distance denoted as C–D for hinge point H. In both relationships, the distance must be greater than 0.005-inch and generally less than 0.150-inch. The preferred distance of the current invention is approximately 0.030 to 0.040 inch for both distances. The relationship between wall thickness E–F and B–D is that wall thickness B–D must be less than wall thickness E–F generally by a 30% to 60% factor but can be as high as a 15% to 85% factor.

Figure 5:
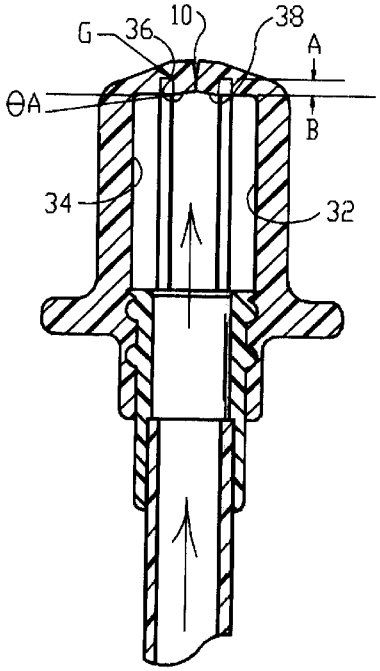
FIG. 5 is a cross-sectional view, as seen in FIG. 2, of the present invention being placed under a positive static head of pressure as shown by the arrows.

For the present invention, wall thickness B–D is approximately 60% that of E–F. FIG. 5 shows the current embodiment of FIG. 2 placed under positive internal pressure as shown by the arrows. Internal surfaces 36 and 38 are shown flexing and rotating about hinge point G. Under positive internal pressure, the angle in which the inner most wall of 36 and side wall 34 and inner most wall of 32 and side wall 38 form becomes greater than when pressure is not applied. Angle θA denotes the increase in angle as positive pressure is applied. The distance denoted as A–B acts to further enhance the seal of through slit 10.

Figure 6:
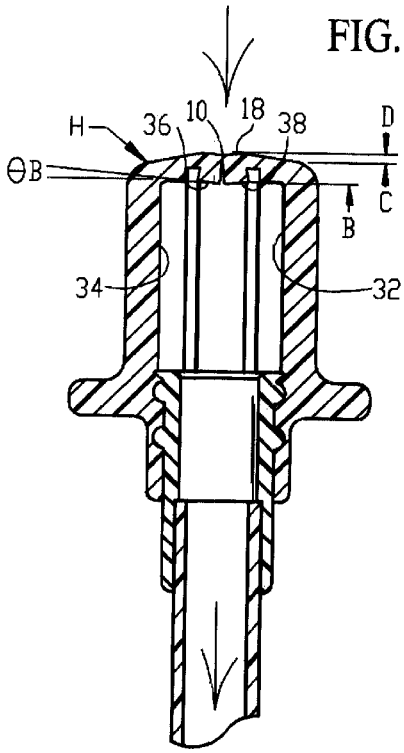
FIG. 6 is a cross-sectional view, as seen in FIG. 2, of the present invention being placed under a negative static head of pressure as shown by the arrows.

FIG. 6 shows the current embodiment of FIG. 2 when placed under negative internal pressure as shown by the arrows. External surface 18 and 19 are shown flexing and rotating about hinge point H. Under negative internal pressure, the angle in which walls 36 and 34 and walls 32 and 38 from become less than when pressure is not applied. Angle θB denotes the decrease in angle as a negative pressure is applied. The distance denoted as C–D acts to further enhance the seal of through slit 10. Both actions of preventing flow under negative and positive pressures can be accomplished with a wall thickness denoted as B–D of approximately 0.100 to 0.125-inch.

Figure 7:
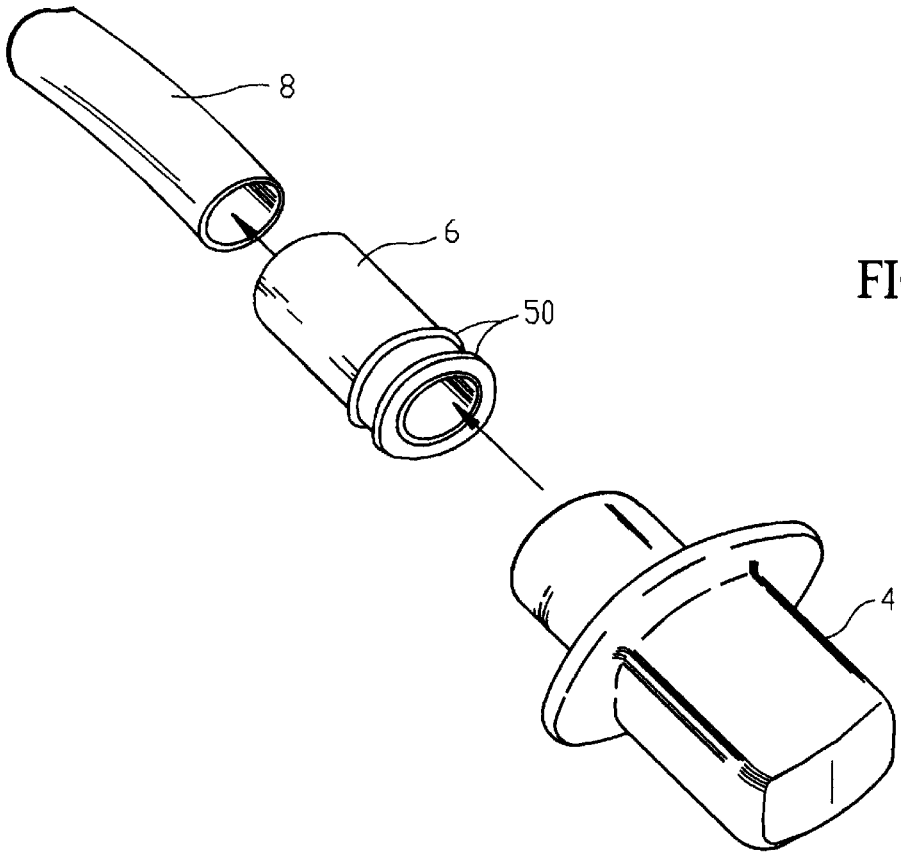
FIG. 7 is an exploded view of all components in proper relationship of the fluid dispensing unit.

FIG. 7 shows an isometric exploded view of FIG. 1. The relationship of flexible member 4, hard member 6 and connection tube 8 become apparent.

Figure 8:
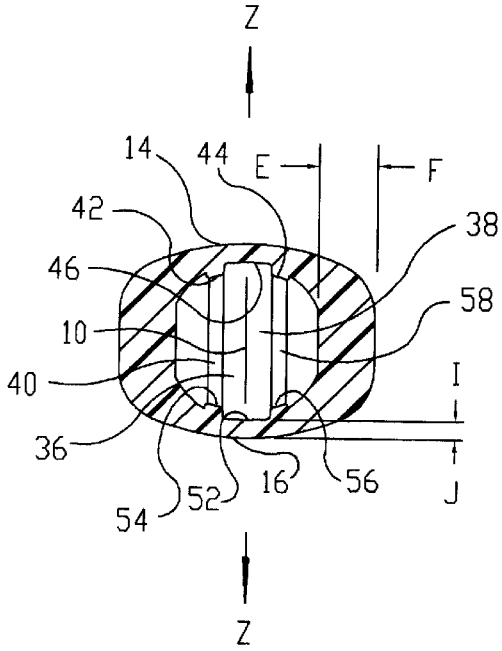
FIG. 8 is a cross-sectional view of the flexible member as shown in FIG. 1, viewed from arrows 8—8 showing the internal projections that creates a properly sized ice shard and the proper relationship of wall thickness.

FIG. 8 shows a sectioned view of FIG. 1 as seen from arrows 8—8. The relationship between wall thickness E–F, B–D and I–J is now explained as wall thickness I–J is the thinnest of the three walls. Internal wall surface 46 and outer wall surface 14 are separated by a distance denoted as I–J. This distance is the smallest of all three walls specific to the flexible member. When a positive internal pressure is applied, any wall with a thickness of I–J will be the first to flex. This flexing will be in the direction of arrows denoted as Z—Z. In other words, the distance between surface 14 and 16 will increase, as well as the distance between surface 46 and 52. This flexing will transfer force in the direction of the arrow designated as Z—Z on front surface 36 and 38 effectively forcing through slit 10 to maintain a closed position.

The relationship of wall thickness I–J is about 30% to 60% of wall thickness B–D to generally accomplish this action although a wall thickness of 15% to 85% is also potentially effective.

From this view, forward projecting grooves or cavities 40 and 58 can be seen in proper alignment with through slit 10. Optimum rotation of inner most wall 36 and 38 is accomplished by positioning cavities 40 and 58 parallel to through slit 10. The section of wall 36 located between through slit 10 and cavity 40 and the section of wall 38 located between slit 10 and cavity 58 will now rotate about hinge point G in a linear manner.

That is, wall 36 and 38 will rotate about point G with minimal torsion to the resilient material that comprises the pliable member. This will allow through slit 10 to seal with greater efficiency. As shown in FIG. 5, slit 10 seals in compression along an inner margin when pressure internal to chamber 30 is greater. Similarly, slit 10 seals along an outer margin when the exterior pressure is greater than the chamber 30 pressure as is depicted in FIG. 6.

It should be noted that it is preferred wall 36 and 38 be straight or flat in construction to minimize torsion within the material. A very basic analogy to this concept would be two cabinet doors that swing open from the center. If the hinges are placed parallel to each other and to the doors inner most edge, than the doors swing in proper relationship closing tightly.

Internal projection 42,44, 54 and 56 form an ice tray effect that enhances the ability to manage ice build up in the flexible member of the liquid dispensing unit. Under freezing conditions, the majority of liquid should be vacated from the liquid dispensing and returned to the liquid reservoir where mass to volume ratio of liquid is at the maximum for the system. Any remaining liquid in the flexible member will adhere to the internal walls 32, 34, 46 and 52, as well as internal projections 42, 44, 54 and 56 of the flexible member due to the hydrostatic surface tension of the liquid. As the liquid freezes on the above-mentioned surfaces it will have a high surface to volume ratio.

Once the flexible member is distorted by a biting action of the user, for example, the ice will divide into shards that have a greater surface to volume ratio than before. Once the liquid is drawn from the reservoir to the user through the fluid dispensing unit it will pass over the ice shards raising the surface temperature of the ice shard. The ice shards will return to a liquid state and pass through slit 10 to the users.

Figure 9:
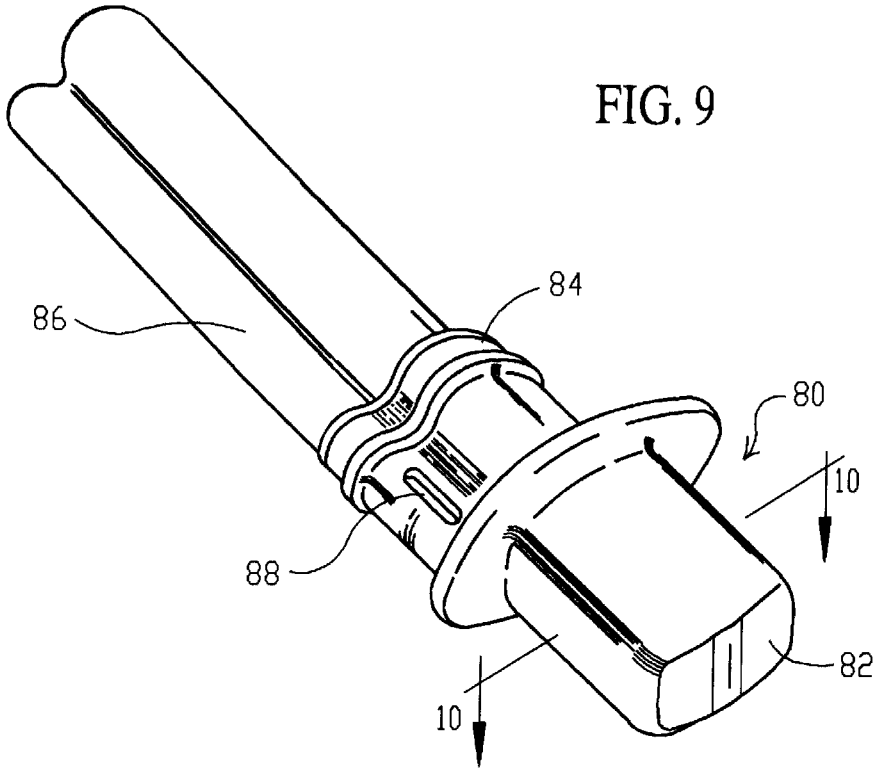
FIG. 9 is an isometric view of another embodiment of the liquid dispensing unit with an additional cavity contained in the flexible member. The additional cavity houses an auxiliary air vent as described in patent application Ser. No. 09/179,337 for Human Hydration System.
Figure 10:
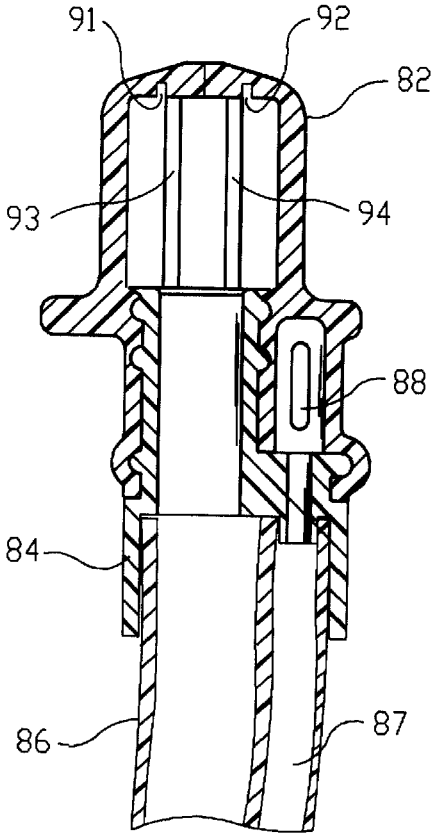
FIG. 10 is a cross-sectional view of FIG. 9 looking in the direction of arrows 10—10.

FIG. 9 depicts the liquid dispenser unit 80 constructed and operating substantially as described above but modified in accordance with the hydration system employing a remote air line pursuant to the teachings of copending patent application 09/179,337. FIG. 10 is a section view taken along the plane defined by section lines 10—10 in FIG. 9.

Dispenser unit 82 has a truss shaped outer face with a through slit for retaining or dispensing liquid as described previously herein. Collar 84 attaches to dual passageway tubing 86. Slot 88 opens into a chamber terminating air return tubing portion 87 with that chamber suitable for receipt of a filter element if desired.

Internal grooves 91 and 92 establish hinge points while ribs 93 and 94 can provide ice control, all as discussed above. Note that grooves 91 and 92 are positioned in somewhat offset relation with respect to ribs 93 and 94.

For one model of a bite valve in accordance with this invention, the dimensions as shown in FIGS. 3–6 and 8 are as follows. The A–B dimension is 0.045 inches and B–D is 0.110-inches while C–D is 0.038-inches. E–F is 0.150 and I–J is 0.05-inches. The theta angle is 16.5 degrees with theta-A approximately 9–11 degrees and theta-B 8–10 degrees.

Thus the thickness of the truss-like top or end wall containing slit 10 and enclosing one end of interior chamber 30 is slightly less than the thickness of the thicker side wall pair at the central portion thereof, but reduces to about half the thicker side wall dimension at the hinge line G. The reduction via slits or grooves such as 40 and 58 which extends nearly half way through the to wall provides hinge lines on either side of slit 10. Accordingly, hinge lines are established along lines G, along the base of slits or grooves, such as 40 and 58, or both.

While the present invention has been shown and described with particularity with respect to the exemplary preferred embodiments, those having normal skill in the art will recognize various changes, modifications, additions and applications other than those specifically mentioned herein.

What is claimed is:

1. The method of selectively extracting fluid from a fluid supply comprising the steps of:

forming a flexible housing of side walls and an end wall defining an internal chamber with the end wall having a flat interior surface facing the chamber;

establishing a slit through the end wall so that pressure differentials between the exterior and interior of the housing will cause the slit to increase closing pressure along an internal margin thereof;

coupling the internal chamber to the fluid supply;

fabricating the side walls of the housing for accommodating manual collapse of the housing and opening of the slit for permitting transmission of fluid from the supply through the slit; and forming channels within the chamber for facilitating removal of ice from within the chamber when the housing is subjected to a freezing environment.

2. A bite valve for attachment to a fluid supply tube comprising:

a flexible housing having an internal cavity formed by four side wall members, a top wall member enclosing said four wall members on one end of said cavity, and means in proximity to the other end of said cavity for establishing fluidic communication with the fluid supply tube;

a first and second of said side wall members being located as diametrically opposed wall members, and a third and fourth of said side wall members being as diametrically opposed side wall member that extend generally normal to said first and second side wall members;

a normally closed slit extending through said top wall member with said slit opening upon pressure being applied to said opposing pair of said wall members thereby establishing a fluid flow line through said cavity;

the interior surface facing said chamber from said top wall being substantially flat and perpendicular to said fluid flow lines;

wherein said cavity is formed with a rectangular cross-section by said side walls and said slit extends through said top wall in a direction transverse to the longer dimension of said rectangular cross-section; and wherein the longer pair of said side walls each includes a channel extending parallel to the length of said cavity for entrapping ice when the bite valve is in a freezing environment.

3. The bite valve of claim 2 wherein said channels each have ribs extending from the sides thereof into the interior of said cavity for facilitating release of ice formed within said cavity.

4. A bite valve comprising:

a flexible body including four side walls surrounding an elongated chamber, an end wall enclosing one end of said chamber, and means for introducing fluid from a fluid source into said chamber from the other end;

at least one pair of said side walls located on opposing sides of said chamber with each said side wall of said pair having a substantially greater thickness than the thickness of said end wall, and said end wall enclosing one end of said chamber with a flat interior surface and having a slit extending there through in a direction parallel to the narrower dimension of said chamber, the surface of said end wall exterior to said chamber being formed with a substantially flat central portion containing said slit and two generally flat side portions sloping away from said central portion whereby said end wall has a truss-like profile;

said end wall in proximity to the outer ends of said end side portions having a thickness less than said side walls of said pair for establishing hinged lines for causing said slit to pivot into sealed relation along an inner margin thereof in response to pressure differentials between said chamber and the exterior of said end wall, the thickness relation between said side walls permitting inwardly directed manual deflection to open said slit thereby communicating fluid from the source through said chamber to the exterior of said body when the pressure of the environment exterior to said body is less than the pressure on the fluid from the source; and channels in each said side walls forming the longer sides of said rectangular chamber for expediting recovery from said fluid freezing within said chamber.

5. Apparatus in accordance with claim 4 wherein said channels each include ribs located on the periphery of each said channel with said ribs extending into the interior of said chamber.

6. A mouth operated valve for attachment to a fluid supply tube comprising:

a flexible housing having an internal cavity formed by four side wall members, a top wall member enclosing said four wall members on one end of said cavity, and means in proximity to the other end of said cavity for establishing fluidic communication with the fluid supply tube;

a first and second of said side wall members being located as diametrically opposed wall members, and a third and fourth of said side wall members being as diametrically opposed side wall member that extend generally normal to said first and second side wall members;

a normally closed slit extending through said top wall member with said slit opening upon pressure being applied to said first and second opposing wall members, thereby establishing a fluid line through said cavity;

wherein said first and second side wall members each comprise an interior wall, each interior wall having at least one channel extending into said cavity for entrapping ice when the bite valve is in a freezing environment.

7. A bite valve in accordance to claim 6, wherein said channels run parallel to said wall members.

8. A bite valve in accordance to claim 6, wherein said channels are continuous.

9. A bite valve in accordance to claim 6, wherein an interior surface of said top wall member is at a right angle to said first and second side wall members.

10. A bite valve in accordance to claim 6 wherein an exterior surface of said top wall member is truss-like in cross section.

* * * * *